US005794763A

United States Patent [19]

Ogasawara

[11] Patent Number: 5,794,763

[45] Date of Patent: Aug. 18, 1998

[54] CIRCUIT BREAKER

[75] Inventor: Makoto Ogasawara, Tochigi, Japan

[73] Assignee: Fuji Electric Co., Ltd., Kawasaki, Japan

[21] Appl. No.: 888,401

[22] Filed: Jul. 7, 1997

[30] Foreign Application Priority Data

Jul. 9, 1996 [JP] Japan ..... 8-198364

[51] Int. Cl.[6] ..... H01H 23/00

[52] U.S. Cl. ..... 200/401; 200/293

[58] Field of Search ..... 200/400, 401, 200/293, 339, 318

[56] References Cited

U.S. PATENT DOCUMENTS 4,786,771 11/1988 Iio et al. ..... 200/401

5,302,787 4/1994 Edds et al. ..... 200/401

5,449,871 9/1995 Batteax et al. ..... 200/401

*Primary Examiner*—David J. Walczak

*Attorney, Agent, or Firm*—Kanesaka & Takeuchi

[57] ABSTRACT

A circuit breaker of the invention is formed of a container and a switch mechanism unit accommodated in the container. The switch mechanism unit is formed of a handle lever having a rotating shaft, a handle and lever arms; a movable contact having a movable contact point at one end with the other end rotatably joined with the lever arms; and a latch disposed to cross the rotating shaft and having a rotating shaft and an engaging arm protruding from the rotating shaft. A switch spring is disposed between the latch and the movable contact. The handle lever and the rotating shaft of the latch engage semi-circular bearing notches of a case and a cover of the container so that the switch mechanism unit is rotationally supported and held in the container.

6 Claims, 5 Drawing Sheets

CIRCUIT BREAKER

BACKGROUND OF THE INVENTION AND RELATED ART STATEMENT

The present invention relates to a circuit breaker, such as a wiring breaker or a leakage breaker, used for a low voltage cable run, and in particular, to a switch mechanism section with a simplified structure.

FIG. 10 is a vertical cross sectional view showing a switch mechanism section of a circuit breaker of the above kind, which is separated from a case. In FIG. 10, the switch mechanism section is assembled in a frame 1 made of a steel plate, and a latch 3 rotatably joined with the frame 1 at the left end of the figure via a latch pin 2 and a holder 5 made of an insulating material that holds a movable contact 4, are joined together via a toggle link 6. The toggle link 6 comprises an upper link 6*a* and a lower link 6*b*, which are joined together via a toggle pin 7.

The movable contact 4 is rotatably supported by the holder 5 via a pin 8 and urged counterclockwise in the figure by a contact spring 9 comprising a torsion spring. A switch lever 10 with an operation handle (not shown) is rotatably supported at the head of the frame 1, and a switch spring 11 extends between the switch lever 10 and the toggle pin 7. Under this condition, although the latch 3 is subjected to receive a rotational force caused by the tension of the switch spring 11 to act counterclockwise in the figure wherein the latch pin 2 serves as a supporting point, it is retained in the illustrated position because the right end of the apparatus in the figure is engaged with a latch receiver (not shown).

The switch mechanism section is inserted into a case 12 of the circuit breaker as shown by the arrow in the figure. The bottom of the frame 1 is fixed to the case 12 by a screw (not shown), while the holder 5 is rotatably supported by a bearing notch 14 in the case 12 via an integrated switch shaft 13. As is well known, in this switch mechanism section, when the switch lever 10 is rotated to the right from the ON state shown in the figure, the effect of the switch spring 11 on the toggle link 6 is reversed to cause the toggle link 6 to collapse, and the holder 5 is driven clockwise to cause the movable contact 4 to be opened and disconnected. In addition, in the illustrated ON state, when the latch 3 is disengaged from the latch receiver by the operation of an overcurrent trip device (not shown), the latch 3 is rotated counterclockwise by using the latch pin 2 as a supporting point to reverse the effect of the switch spring 11 on the toggle link 6. As a result, the toggle link 6 collapses to cause the movable contact 4 to be opened and disconnected.

Such a conventional switch mechanism section has a large number of parts, including the frame 1 as well as a complicated structure. In addition, FIG. 10 shows that the switch mechanism section is an integrated one. During an actual assembly, however, the holder 5 with only the lower link 6*b* of the toggle link 6 joined therewith is first inserted into the case 12; the latch 3 with the upper link 6*a* joined therewith and the frame 1 with the switch lever 10 assembled therein are then fixed to the case 12 by screws; the upper link 6*a* and the lower link 6*b* are then joined together via a toggle pin 7; and the switch spring 11 is subsequently attached to the toggle pin 7. In this job, the operation of stretching the switch spring 11 while locking it on the toggle pin 7 within the narrow case 12 is very cumbersome and requires much labor and skill.

It is thus an object of this invention to simplify the structure of the switch mechanism section to allow easy assembly operations.

SUMMARY OF THE INVENTION

This invention allows a latch to be directly supported by a case in order to eliminate the need for a frame; avoids the use of a toggle link to simplify the structure; and enables a switch mechanism section to be integrally assembled as a unit, which can then be incorporated in the case, to thereby allow easy assembly operations.

That is, according to the invention, a switch mechanism unit comprises a handle lever crossing a rotating shaft and including a handle and lever arms protruding in an approximately opposite direction relative to the handle; a movable contact having a movable contact point at one end with the other end rotatably joined with the tips of the lever arms; a latch that crosses the rotating shaft and from which an engaging arm protrudes; and a switch spring, one end being attached to the latch and the other end being attached to the movable contact. The switch mechanism unit is supported by semi-circular bearing notches in the case and cover at the handle lever and the rotating shaft of the latch.

In this case, a part of the movable contact engages the latch with the switch spring extending between the latch and the movable contact, and a groove is disposed in the latch to allow the movable contact to be temporarily fixed. This prevents the movable contact from being deflected during insertion into the case, to thereby allow easier assembly operations.

DETAILED DESCRIPTION OF A PREFERRED EMBODIMENT

Figure 1:
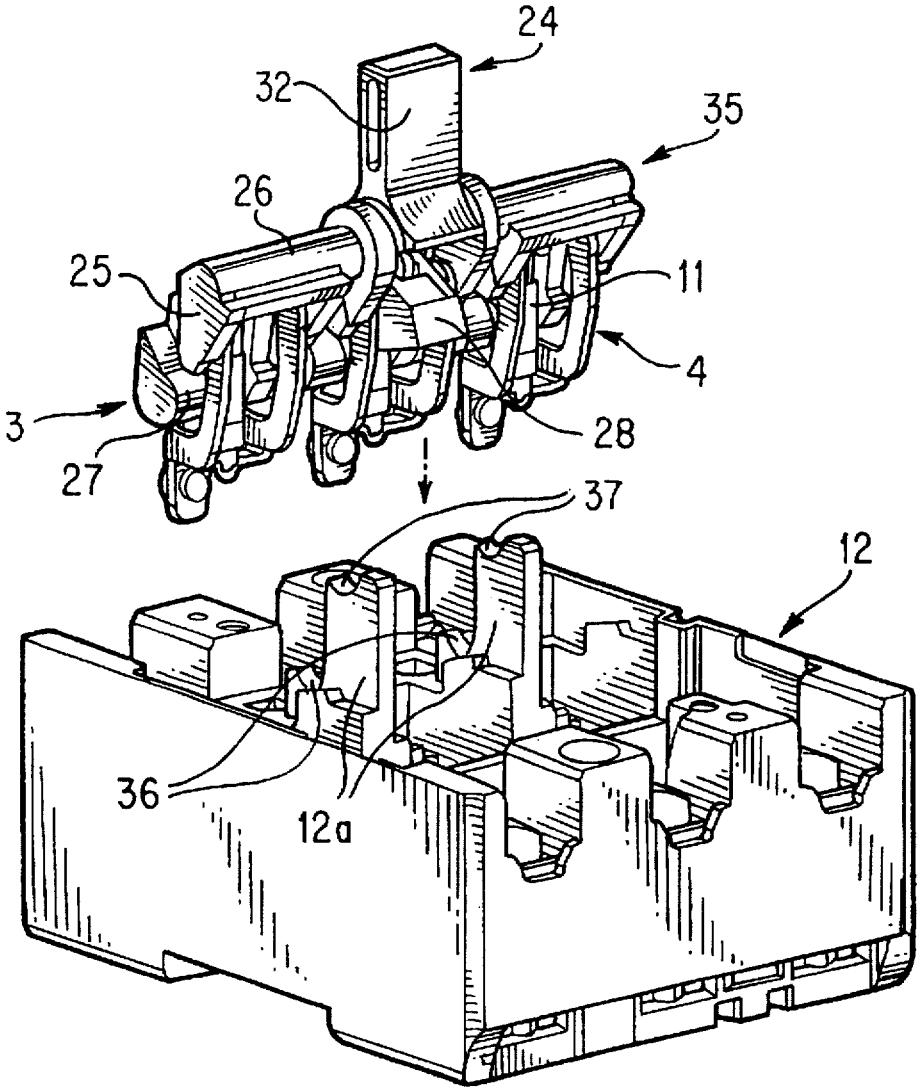
FIG. 1 is a perspective view of a circuit breaker according to an embodiment of this invention, in which a switch mechanism unit and a case are separated from each other.
Figure 2:
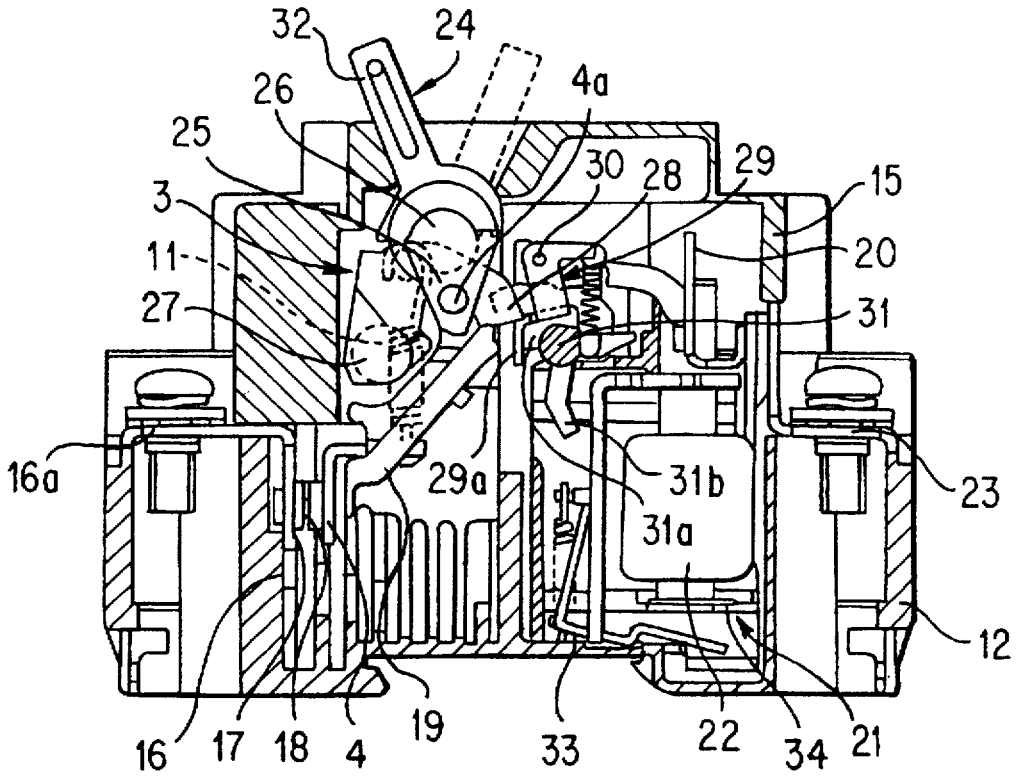
FIG. 2 is a vertical cross sectional view of the circuit breaker shown in FIG. 1.

An embodiment of a three-pole circuit breaker, i.e. wiring breaker, according to this invention is described below with reference to FIGS. 1 to 9. The same components as in the conventional example carry the same symbols. FIG. 2 is a vertical cross sectional view showing the overall configuration of the circuit breaker, wherein the circuit breaker comprises a switch mechanism section and an overcurrent trap device which are accommodated in a container made of an insulating material comprising a case 12 and a cover 15.

In the ON state shown in FIG. 2, a current path is formed of an inverse-L-shaped fixed contact 16 having a power supply terminal 16*a* at one end and a fixed contact point 17 at the other end; a movable contact 4 having a movable contact point 18 that contacts the fixed contact point 17; a lead 19, one end of which is connected to the movable contact 4; a coil 22 in an overcurrent trap device 21 wherein the other end of the lead 19 is connected to one of the trap wires of the coil 22 via a relay terminal 20; and an L-shaped load terminal 23 to which the other trap wire of the coil 22 is connected.

The movable contact 4 is rotatably joined with the tips of lever arms 25 of a handle lever 24 via protruding shafts 4*a* at the tops thereof. The handle lever 24 is rotatably supported by semi-circular bearing notches in the case 12 via a rotating shaft 26, and held by the cover 15 having semi-circular bearing notches corresponding to the above bearing notches. A switch spring 11 comprising a tension spring extends between the movable contact 4 and a latch 3, and the movable contact 4 is subjected to receive a rotational force caused by the tension of the switch spring 11 to act clockwise in the figure wherein the protruding shaft 4*a* serves as a supporting point, so that the movable contact point 18 is pressed against the fixed contact point 17. The latch 3 is rotatably supported by semi-circular bearing notches in the case 12 via a rotating shaft 27, and held by the cover 15 having the semi-circular bearing notches corresponding to these bearing notches.

The latch 3 is subjected to receive a rotational force caused by the tension of the switch spring 11 to act clockwise in the figure wherein the rotating shaft 27 serves as a supporting point, but is retained in the illustrated position because the tip of an engaging arm 28 is engaged with a latch receiver 29. Although a detailed configuration is omitted, the latch receiver 29 is rotatably supported by a pin 30, and subjected to receive a rotational force provided by the latch 3 to act counterclockwise in the figure wherein the pin 30 serves as a supporting point. The latch receiver, however, is retained in the illustrated position because a hook 29*a* abuts against a claw 31*a* of a stop bar 31. In this ON state, when an operation handle 32 of the handle lever 24 protruding from the cover 15 is rotated to the position shown by a broken line, the effect of the switch spring 11 against the movable contact 4 is reversed to drive the movable contact 4 counterclockwise. Consequently, the movable contact 4 is opened and disconnected from the fixed contact 16 (OFF operation).

In addition, in an overcurrent state, an armature 33 of an overcurrent trap device 21 is attracted to an armature 34 to press a trip arm 31*b* of a trip bar 31 to thereby rotate the trip bar 31 clockwise in the figure. Thus, the claw 31*a* of the trip bar 31 is removed from the hook 29*a* of a latch receiver 29, and the latch receiver 29 is rotated counterclockwise. As a result, the disengaged latch 3 is rotated clockwise in the figure, and the effect of the switch spring 11 on the movable contact 4 is reversed to thereby cause the movable contact 4 to be opened and disconnected from the fixed contact 16 (trip operation).

Figure 3A:
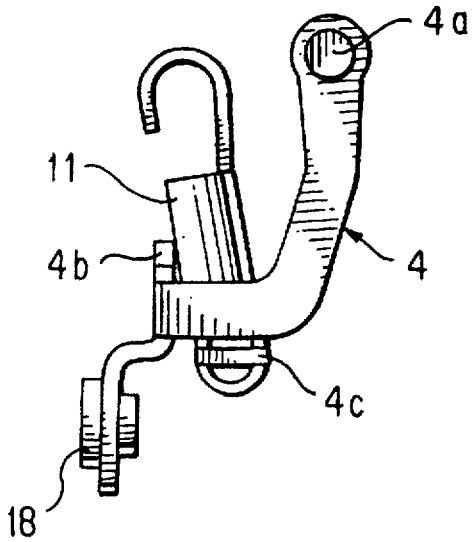
FIG. 3(A) is a side view of a movable contact as shown in FIG. 1.
Figure 3B:
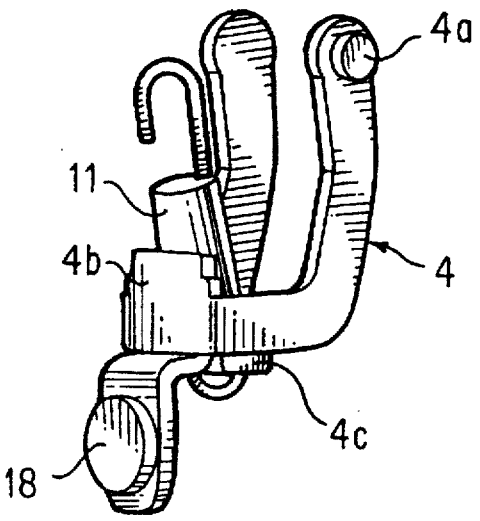
FIG. 3(B) is a perspective view of the movable contact.

FIG. 3(A) shows a side view of the movable contact 4, and FIG. 3(B) is a perspective view thereof. The movable contact 4 is formed to have a lateral pair of arms by a press-stamped plate conductor as illustrated. The movable contact point 18 is integrally joined with the movable contact 4 by press-fitting, and the protruding shafts 4*a* are integrally formed at the tips of the arms so as to protrude outwardly. In addition, a tongue piece 4*b* that is caught in the groove in the latch 3 is formed between the arms so as to extend vertically, and a spring peg 4*c* is formed by bending so as to extend laterally from one of the arms. One end of the switch spring 11 is caught around the spring peg 4*c* at the beginning of an assembly operation as illustrated. Although not shown in FIGS. 3(A) and 3(B), the lead 19 (FIG. 2) is connected to the rear surface, i.e. the right end surface in FIG. 3(A), of the movable contact point 18 by spot welding.

Figure 4:
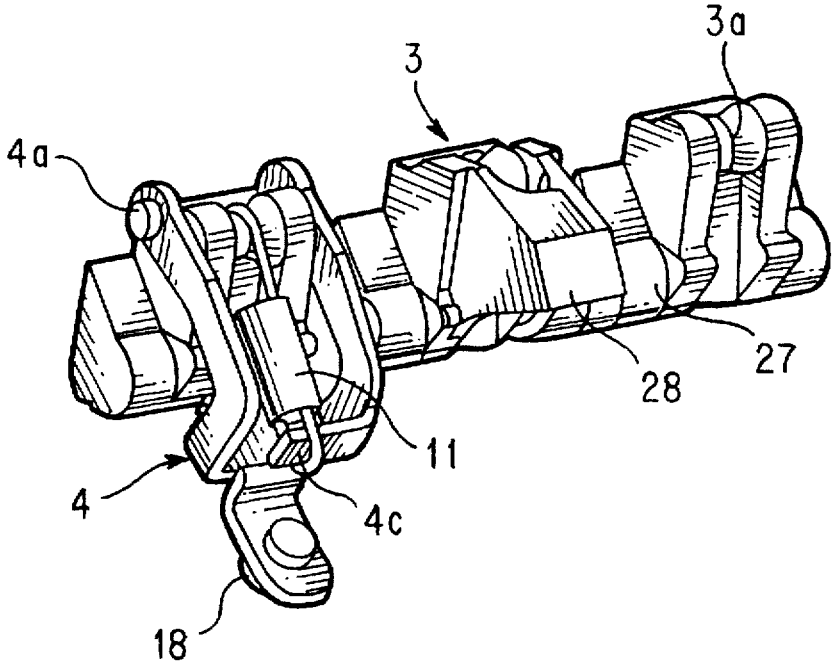
FIG. 4 is a perspective view, in which the movable contact shown in FIGS. 3(A), 3(B) is joined with a latch shown in FIG. 1.
Figure 5:
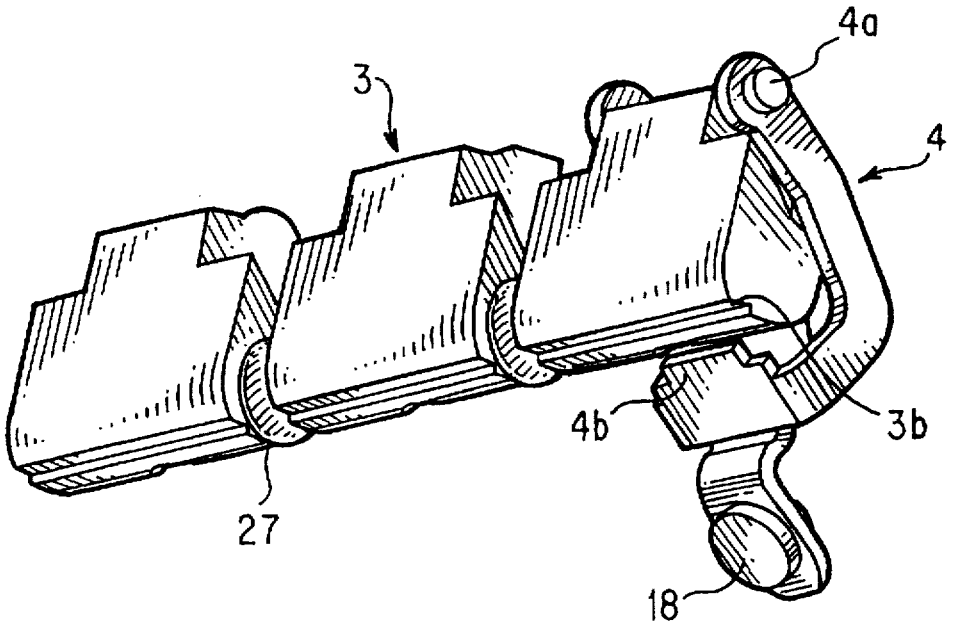
FIG. 5 is a perspective view of the latch and the movable contact shown in FIG. 4 as shown from the opposite direction.

FIG. 4 is a perspective view showing the latch 3. The latch 3 is made of a molded resin, and includes the engaging arm 28 integrally formed in a central pole section so as to cross the rotating shaft 27. In addition, a spring peg 3*a* comprising a constricted shaft portion is integrally formed in the middle of each pole as illustrated. One end of the switch spring 11 with its other end caught around the spring peg 4*c* of the movable contact 4 is caught around the spring peg 3*a* to connect the latch 3 and the movable contact 4 together as illustrated. FIG. 5 shows the latch 3 in FIG. 4 as seen from the opposite direction.

Figure 7:
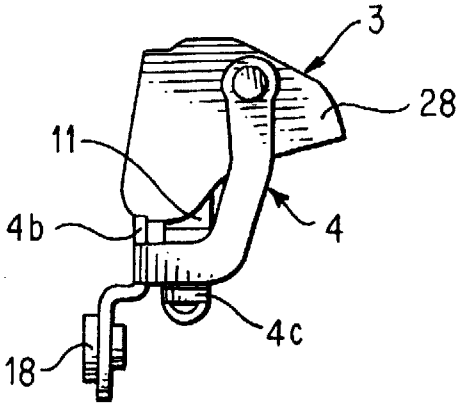
FIG. 7 is a side view for showing the tongue piece of the movable contact locked in the groove in the latch shown in FIG. 5.
Figure 10:
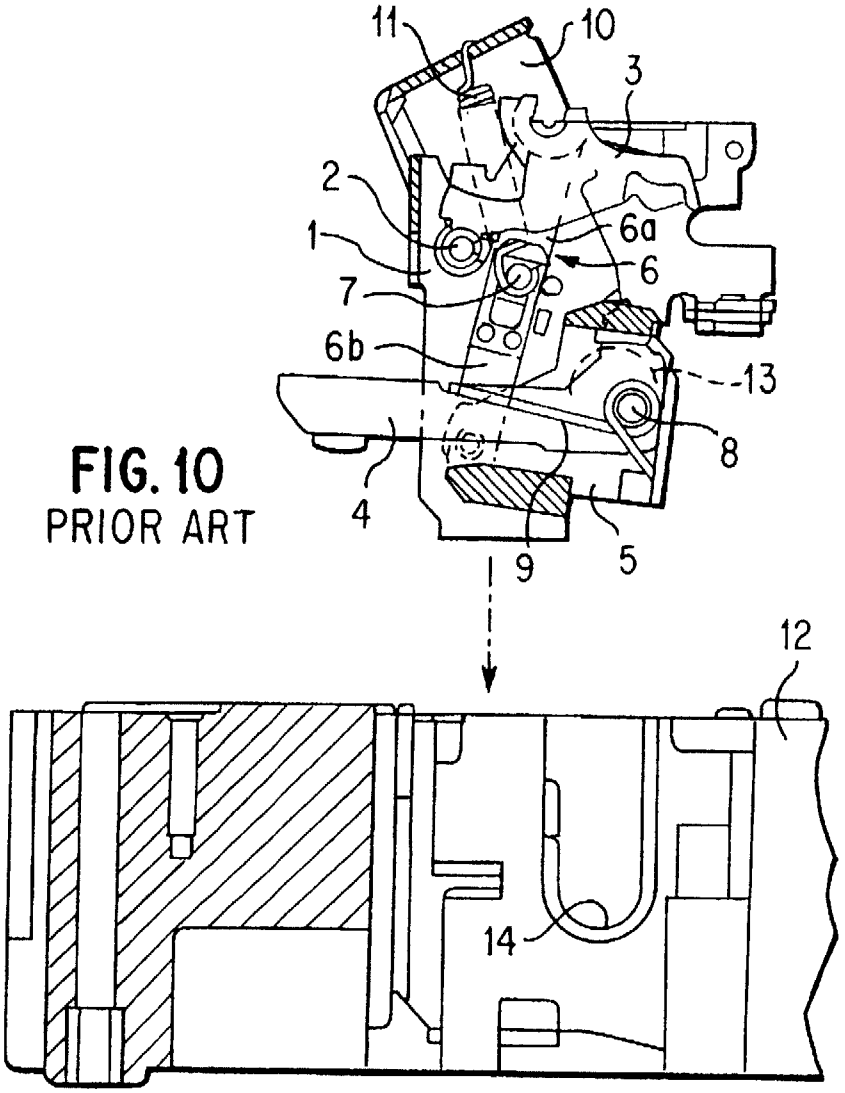
FIG. 10 PRIOR ART
FIG. 10 is a vertical cross sectional view of a conventional circuit breaker, in which a switch mechanism and a case are separated from each other.

As is particularly apparent from FIG. 5, the latch 3 has a groove 3*b* of an L-shaped cross section in which the tongue piece 4*b* of the movable contact 4 is caught. Then, the movable contact 4 connected to the latch 3 is rotated in the direction shown by the arrow to lock the tip of the tongue piece 4*b* in the groove 3*b*, as shown in the side view in FIG. 6. FIG. 7 shows the state after this operation. In this case, the switch spring 11 is stretched, and this tension causes the movable contact 4 to be temporarily fixed to the latch 3 in the state shown in FIG. 7.

Figure 8:
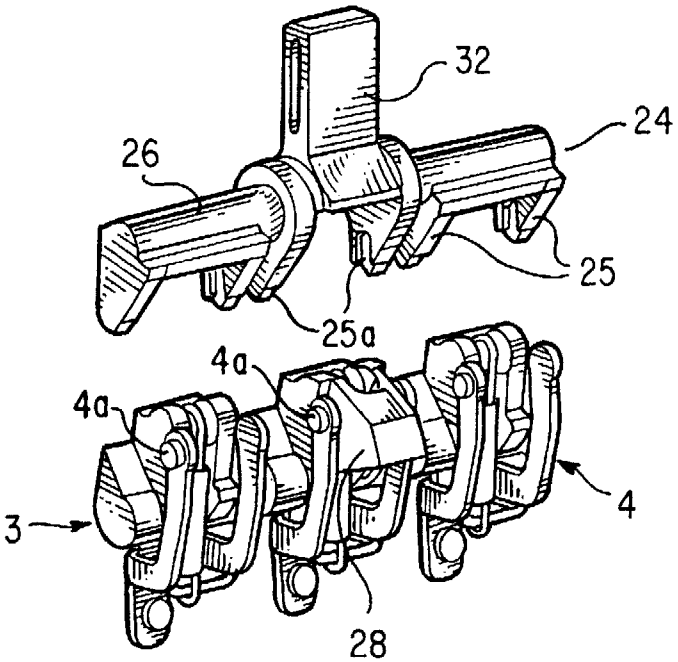
FIG. 8 is a perspective view for showing the movable contact and handle lever of the switch mechanism unit shown in FIG. 1 before joining.
Figure 6:
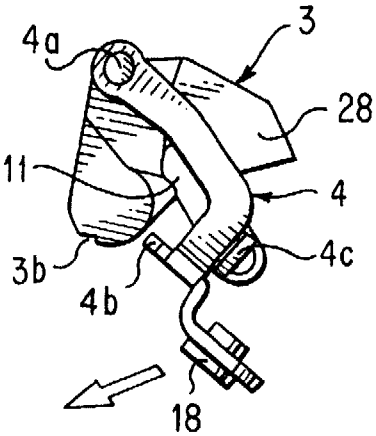
FIG. 6 is a side view for showing how to lock a tongue piece of the movable contact in a groove in the latch shown in FIG. 5.
Figure 9:
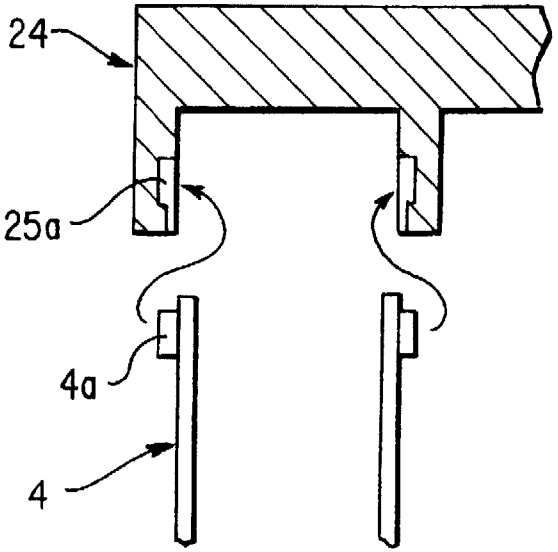
FIG. 9 is a cross sectional view of the integral part shown in FIG. 8.

FIG. 8 is a perspective view showing the latch 3 and the handle lever 24 with the movable contact 4 temporarily fixed thereto. The handle lever 24 is made of a molded resin, and comprises an operation handle 32 and three pairs of lever arms 25, i.e. each pair for each pole, that cross the rotating shaft 26 and are integrally formed so as to protrude in approximately opposite directions. U-shaped bearing notches 25*a* that receive the protruding shafts 4*a* of the movable contact 4 are formed in the inner opposite surfaces at the tips of the lever arms 25. FIG. 9 is an enlarged cross sectional view showing the bearing notch section. A circular recess in which the protruding shaft 4*a* is rotatably fitted is formed in a deep portion of the bearing notch 25*a*. In FIG. 8, when the protruding shafts 4*a* are inserted into the bearing notches 25*a* of the lever arms 25 as the arms of the movable contact 4 is flexed, the protruding shafts 4*a* are fitted in the circular recesses and prevented from removal.

The latch 3, the movable contact 4, the switch spring 11 and the handle lever 24 joined together constitute a single unit 35 (referred to as the "switch mechanism unit"). FIG. 1 is a perspective view showing the switch mechanism unit 35 and the case 12. The case 12 includes a lateral pair of plate-like bearing sections 12*a* integrally extending vertically from the bottom, and semi-circular bearing notches 36 and 37 are formed in two longitudinal positions in the top surfaces of the bearing sections 12*a*. The switch mechanism unit 35 is inserted into the case 12 along the arrow shown in FIG. 1. The portions of the rotating shaft 27 of the latch 3 which are shown with diagonal lines in FIG. 5 are supported by the bearing notches 36, while the portions of the handle lever 24, one of which is shown with diagonal lines in FIG. 8, are supported by the bearing notches 37.

On the other hand, bearing notches are formed in the cover 15, corresponding to the bearing notches 36, 37 as described above. In the final stage of the assembly of the switch mechanism unit 35, the cover 15 is fixed on the case 12 by screws so that the bearing notches of the cover 15 abut against the bearing notches 36, 37. In this case, the movable contact 4 is pressed against the fixed contact 16 to cause the tongue piece **4*b* to be removed from the groove 3*b* of the latch 3, and the tension of the switch spring 11 then causes the movable contact point 18 to be pressed against the fixed contact 17. That is, the switch spring 11** also has a function of a contact spring for generating a contact pressure between the movable and the fixed contact.

According to this invention, the arms of the movable contact are joined with the lever arms of the handle lever; the switch spring extends between the latch and the movable contact to form a switch mechanism unit; and the handle lever and the latch are directly supported by the case. This eliminates the need for a movable contact holder, a toggle link, a contact spring, and a frame, all of which have been required in the conventional structures, to thereby simplify the structure of the switch mechanism. In addition, the switch mechanism unit can be assembled outside the case before it is incorporated into the case, to thereby eliminate the need for cumbersome operations to stretch the switch spring within a narrow case and to allow very easy assembly operations.

What is claimed is:

1. A circuit breaker comprising:

a container having a case and a cover, said case and cover having semi-circular bearing notches facing each other; and a switch mechanism unit accommodated in the container, said switch mechanism unit comprising, a handle lever having a rotating shaft, a handle and lever arms, said handle and lever arms protruding perpendicularly in approximately opposite directions relative to the rotating shaft, a movable contact having a movable contact point at one end with the other end rotatably joined with tips of the lever arms, a latch disposed to cross the rotating shaft and having a rotating shaft and an engaging arm protruding from the rotating shaft, and a switch spring having one end attached to the latch and the other end attached to the movable contact, said handle lever and the rotating shaft of the latch engaging the semi-circular bearing notches of the case and the cover so that the switch mechanism unit is rotationally supported and held in the container.

2. A circuit breaker according to claim 1, wherein said latch includes a groove so that a part of the movable contact is caught at the latch by a force of the switch spring extending between the latch and the movable contact to allow the movable contact to be temporarily fixed thereto.

3. A circuit breaker according to claim 2, wherein said movable contact has a tongue piece engaging the groove of the latch.

4. A circuit breaker according to claim 1, wherein said movable contact includes a pair of arms, protruding shafts extending outwardly from the arms, and a spring peg situated between the arms to receive the other end of the switch spring.

5. A circuit breaker according to claim 4, wherein said lever arms of the handle lever include bearing notches facing each other to receive the protruding shafts therein.

6. A circuit breaker according to claim 5, wherein said latch includes a spring peg to receive the one end of the switch spring.

* * * * *